US010926389B2

(12) United States Patent
Lee

(10) Patent No.: US 10,926,389 B2
(45) Date of Patent: Feb. 23, 2021

(54) POWDER-ACTUATED TOOL

(71) Applicant: Chung-Heng Lee, New Taipei (TW)

(72) Inventor: Chung-Heng Lee, New Taipei (TW)

( * ) Notice: Subject to any disclaimer, the term of this patent is extended or adjusted under 35 U.S.C. 154(b) by 256 days.

(21) Appl. No.: 16/050,774

(22) Filed: Jul. 31, 2018

(65) Prior Publication Data

US 2020/0039045 A1 Feb. 6, 2020

(51) Int. Cl.
*B25C 1/14* (2006.01)
*B25C 1/00* (2006.01)

(52) U.S. Cl.
CPC ..... *B25C 1/143* (2013.01); *B25C 1/008* (2013.01)

(58) Field of Classification Search
CPC ..... B25C 1/00; B25C 1/008; B25C 1/043; B25C 1/047; B25C 1/14; B25C 1/18; B25C 1/143
USPC ..... 227/1, 2, 8, 9, 10, 11
See application file for complete search history.

(56) References Cited

U.S. PATENT DOCUMENTS 3,235,154 A * 2/1966 Mulno ..... B25C 1/143 227/10
3,622,060 A * 11/1971 Gussalli ..... B25C 1/143 227/8
4,358,041 A * 11/1982 Ollivier ..... B25C 1/188 227/10
4,374,567 A * 2/1983 Combette ..... B25C 1/18 227/10
4,487,353 A * 12/1984 Benson ..... B25C 1/14 227/9
4,501,189 A * 2/1985 Brandl ..... F41A 21/30 89/14.4
4,651,912 A * 3/1987 Hawkins ..... B25C 1/188 227/10
4,687,126 A * 8/1987 Brosius ..... B25C 1/143 173/206
4,705,200 A * 11/1987 Kopf ..... B25C 1/123 227/8
4,711,385 A * 12/1987 Jochum ..... B25C 1/14 227/10
4,890,778 A * 1/1990 Hawkins ..... B25C 1/105 227/10
4,909,419 A * 3/1990 Yamada ..... B25C 1/045 227/1
5,016,802 A * 5/1991 Haytayan ..... B25C 1/082 173/DIG. 2
5,029,744 A * 7/1991 Pai ..... B25C 1/143 227/10
5,064,004 A * 11/1991 Lundell ..... F16L 15/006 173/132

(Continued)

*Primary Examiner* — Hemant Desai
*Assistant Examiner* — Jacob A Smith
(74) *Attorney, Agent, or Firm* — Hamre, Schumann, Mueller & Larson, P.C.

(57) ABSTRACT

A powder-actuated tool includes a barrel assembly, a housing, a firing pin device, and a piston assembly. The barrel assembly includes an outer tube, an inner tube movably extending into the outer tube, and a powder chamber. The piston assembly includes a pushing rod and a sleeve member sleeved on the pushing rod in a form-fitting manner. The pushing rod has a main body, a tail section having an outer diameter greater than that of the main body, and a shoulder section connected between the main body and the tail section. The powder-actuated tool further includes a bonding material connected between the pushing rod and the sleeve member.

7 Claims, 8 Drawing Sheets

(56) References Cited

U.S. PATENT DOCUMENTS 5,239,829 A * 8/1993 Blake ..... B25C 1/188 227/10
5,273,198 A * 12/1993 Popovich ..... B25C 1/143 227/10
5,332,140 A * 7/1994 Almeras ..... B25C 1/188 227/10
5,363,736 A * 11/1994 Huang ..... B25C 1/14 227/10
5,388,499 A * 2/1995 Szyndlar ..... B25C 1/163 102/464
5,901,894 A * 5/1999 Melocco ..... B25C 1/14 227/10
6,024,267 A * 2/2000 Chen ..... B25C 1/008 227/142
6,059,162 A * 5/2000 Popovich ..... B25C 1/14 173/DIG. 2
6,085,958 A * 7/2000 Kersten ..... B25C 1/14 173/212
6,695,192 B1 * 2/2004 Kwok ..... B25C 1/008 227/107
7,513,676 B2 * 4/2009 Williams ..... B29C 48/2522 366/79
7,584,879 B2 * 9/2009 Blessing ..... B25C 1/08 227/129
7,914,005 B2 * 3/2011 Blessing ..... B25C 1/008 227/10
8,240,394 B2 * 8/2012 Kobayashi ..... B25D 9/18 173/162.1
2002/0100788 A1 * 8/2002 Jakob ..... B25C 1/14 227/10
2002/0108990 A1 * 8/2002 Dittrich ..... B25C 1/14 227/10
2003/0116603 A1 * 6/2003 Connell ..... B25C 1/14 227/10
2004/0094595 A1 * 5/2004 Sprenger ..... B25C 1/14 227/10
2004/0104259 A1 * 6/2004 Sprenger ..... B25C 1/14 227/10
2005/0035172 A1 * 2/2005 Popovich ..... B25C 1/186 227/10
2005/0051591 A1 * 3/2005 Rohrmoser ..... B25C 1/14 227/10
2007/0057007 A1 * 3/2007 Hahn ..... F16F 7/015 227/10
2007/0057008 A1 * 3/2007 Franz ..... B25C 1/14 227/10
2008/0296338 A1 * 12/2008 Blessing ..... B25C 1/008 227/8
2009/0159634 A1 * 6/2009 Lee ..... B25C 1/143 227/9
2009/0166392 A1 * 7/2009 Dion ..... B25C 1/042 227/130
2010/0270351 A1 * 10/2010 Lee ..... B25C 1/087 227/9
2010/0270352 A1 * 10/2010 Popovich ..... B25C 1/14 227/10
2010/0301091 A1 * 12/2010 Liang ..... B25C 1/008 227/8
2011/0057014 A1 * 3/2011 Yang ..... B25C 1/008 227/8
2011/0168754 A1 * 7/2011 Lee ..... B25C 1/146 227/9
2011/0198382 A1 * 8/2011 Masas ..... B25C 1/12 227/9
2011/0198383 A1 * 8/2011 Masas ..... F16B 19/14 227/9
2012/0037683 A1 * 2/2012 Lee ..... B25C 1/188 227/10
2012/0223119 A1 * 9/2012 Herelier ..... B25C 1/008 227/8
2012/0292064 A1 * 11/2012 Franz ..... B25C 1/047 173/46
2013/0206809 A1 * 8/2013 Popovich ..... B25C 1/14 227/8
2014/0239566 A1 * 8/2014 Kok ..... F16F 3/12 267/140.3
2015/0097016 A1 * 4/2015 Masas ..... B25C 1/10 227/9
2016/0214247 A1 * 7/2016 Lee ..... B25C 1/008
2016/0339574 A1 * 11/2016 Fielitz ..... B25C 1/143

* cited by examiner

POWDER-ACTUATED TOOL

FIELD

The disclosure relates to a powder-actuated tool, and more particularly to a powder-actuated tool having an improved piston.

BACKGROUND

U.S. Pat. No. 8,042,719 discloses a powder-actuated tool that has a hollow tool body shaped as a handgun, an inner tube movable forwardly and backwardly within the tool body, a piston movable forwardly and backwardly within the inner tube, a powder cartridge disposed at a rear end of the inner tube, and a firing device for igniting the powder cartridge. When the powder cartridge is ignited to explode, the piston is pushed by the gas produced due to the explosion of the powder cartridge to move forwardly for driving a nail into a hard material, such as concrete or steel, so that objects can be fixed on the hard material using the powder-actuated tool. Since the strength of the powder-actuated tool is much greater than that of nail guns using other kinds of powering mechanisms, the piston that bears the impact from the explosion may be relatively easily damaged at stress concentrations, such as a joint between a large-diameter portion and a mediate-diameter portion, and a joint between the mediate-diameter portion and a small-diameter portion.

U.S. Pat. No. 9,833,889 discloses a nail-driving gun trigger assembly a conventional nail-driving gun (see FIG. 1) having a piston 50 that includes a piston rod 500 and a piston sleeve 510 connected to the piston rod 500 by brazing or rivet connection. The two-piece structure of the piston 50 may alleviate the stress concentration, thereby prolonging the life of the piston 50. Referring further to FIG. 2, when such a conventional nail-driving gun is under normal use to apply a nail to a base object, the piston 50 driven by the exploded gas fixes the nail onto the base object. The high impact from the head of the nail applies onto a piston tip 70 and the two-piece structure of the piston 50 can effectively alleviate the stress concentration to prolong the life of the piston 50. However, when the conventional nail-driving gun is under abnormal use, for example, when a user applies a nail to a base object having too soft a structure or a user forgets to put the nail in the conventional nail-driving gun, the insufficient resistance provided by the base object may cause excessive movement of the piston 50 (called "piston overdrive" in the industry), so the piston sleeve 510 may strike a buffer 60 in the conventional nail-driving gun and the main impact to the piston 50 is applied to a striking point 80 of the piston sleeve 510 instead of the piston tip 70, as shown in FIG. 3. After a period of abnormal uses, the piston rod 500 and the piston sleeve 510 may break or become separated from each other.

SUMMARY

Therefore, an object of the disclosure is to provide a powder-actuated tool that can alleviate at least one of the drawbacks of the prior art and perform well under both normal use and abnormal use.

According to the disclosure, the powder-actuated tool includes a barrel assembly, a housing, a firing pin device, a piston assembly and a bonding material.

The barrel assembly includes an outer tube, and an inner tube that is telescopically connected to the outer tube. The inner tube has a rear end portion formed with a powder chamber for receiving gunpowder. The housing is fixedly connected to a rear end of the outer tube. The firing pin device is disposed in the housing. The piston assembly is disposed in the inner tube of the barrel assembly, and includes a pushing rod and a sleeve member. The pushing rod has a main body, a tail section disposed behind the main body and having an outer diameter greater than that of the main body, and a shoulder section connected between the main body and the tail section and having an outer diameter gradually reducing from the tail section toward the main body. The sleeve member is sleeved on a portion of the main body and the tail section of the pushing rod in a form-fitting manner, and has an inner surface in contact with the pushing rod and having an internal shoulder surface portion which corresponds in shape to the shoulder section of the pushing rod. The bonding material is less hard than the pushing rod and the sleeve member, and is connected between the pushing rod and the sleeve member. The firing pin device is operable to detonate the gunpowder so as to push and move the piston assembly along a moving direction away from the rear end portion of the inner tube to shoot the nail into the object.

BRIEF DESCRIPTION OF THE DRAWINGS

Other features and advantages of the disclosure will become apparent in the following detailed description of the embodiments) with reference to the accompanying drawings, of which.

DETAILED DESCRIPTION

Figure 1:
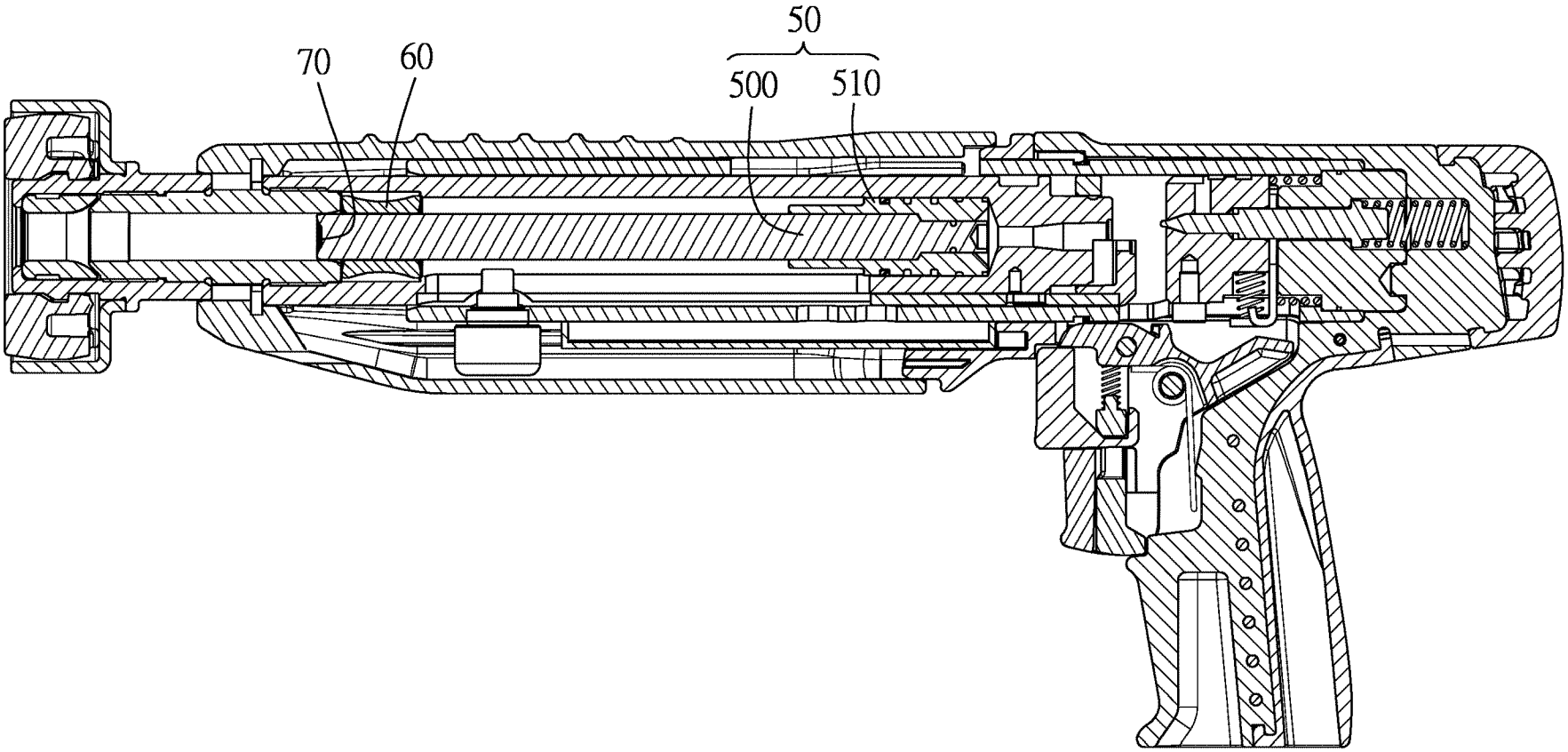
FIG. 1 PRIOR ART
FIG. 1 is a sectional view of a conventional nail-driving gun.
Figure 2:
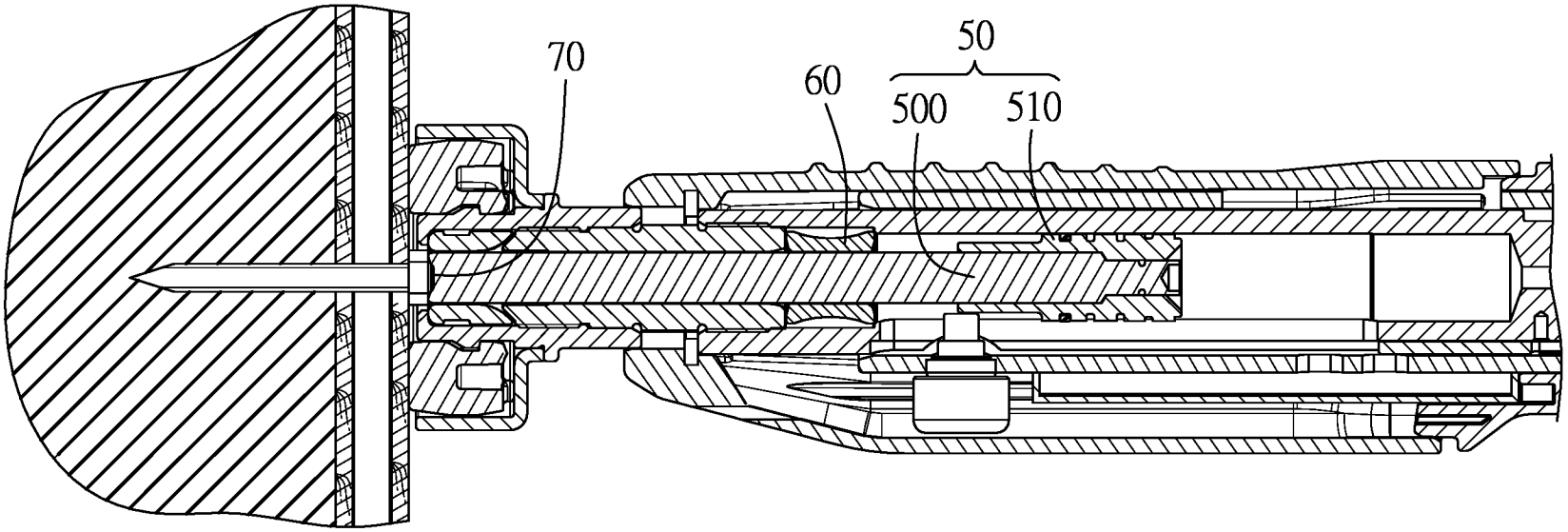
FIG. 2 PRIOR ART
FIG. 2 is a partly sectional view illustrating the conventional nail-driving gun used to apply nail to a hard material.
Figure 3:
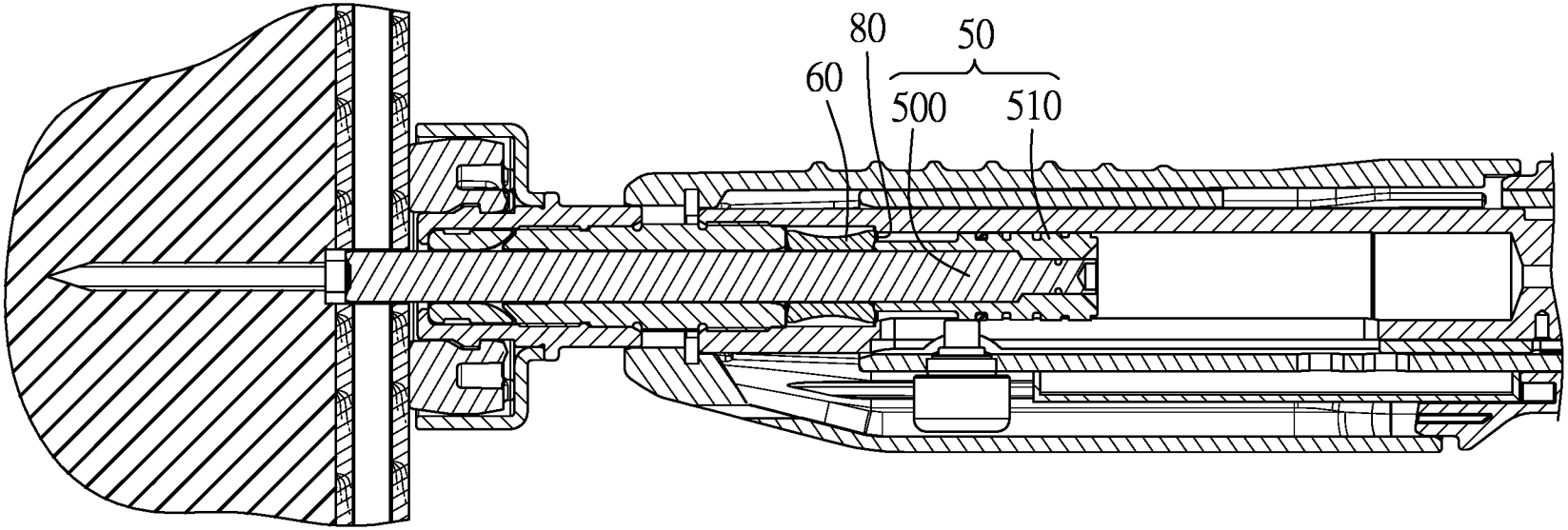
FIG. 3 PRIOR ART
FIG. 3 is a partly sectional view illustrating the conventional nail-driving gun used to apply nail to a soft/hollow material.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 4:
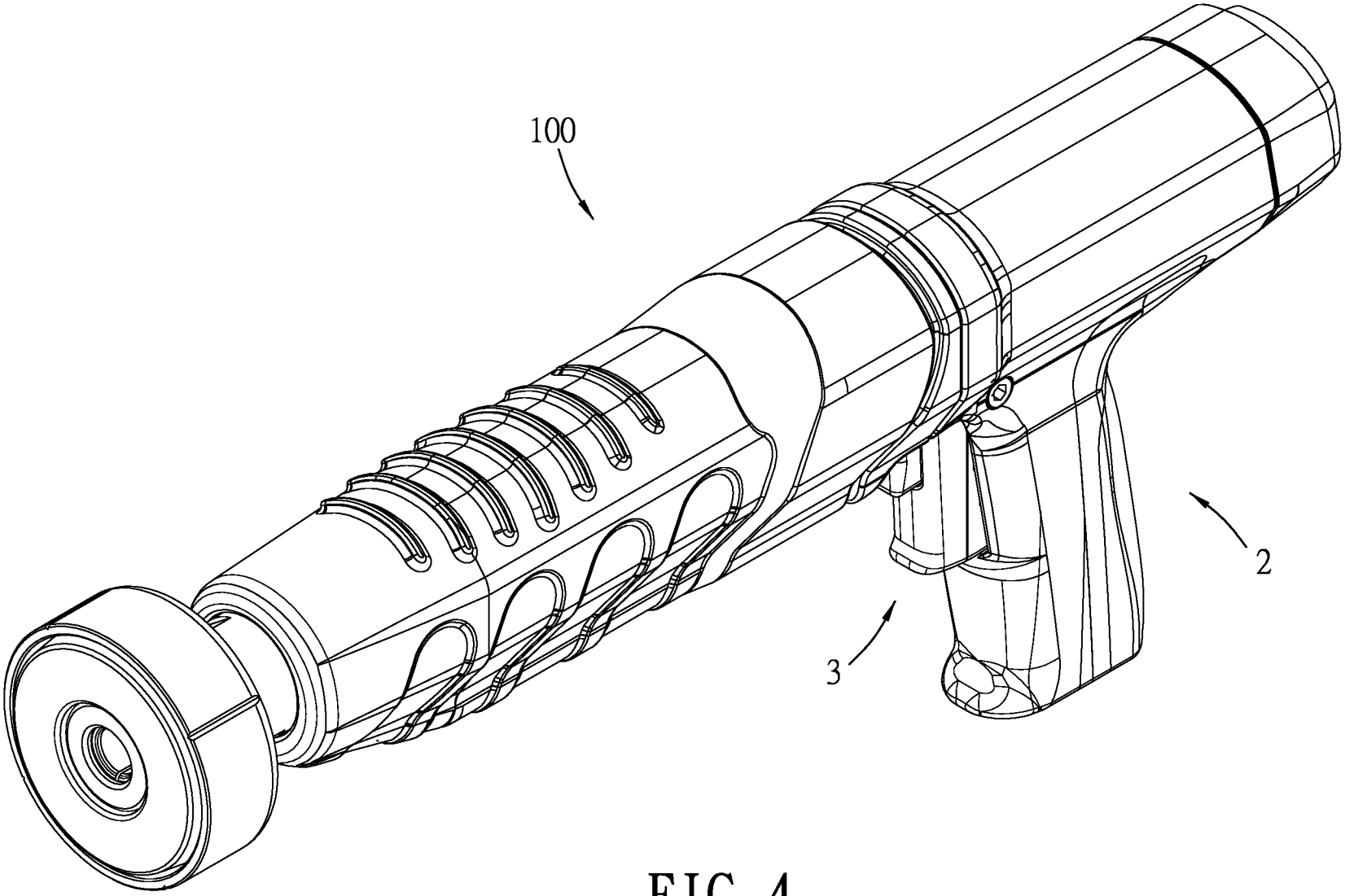
FIG. 4 is a perspective view illustrating an embodiment of a powder-actuated tool according to this disclosure.
Figure 5:
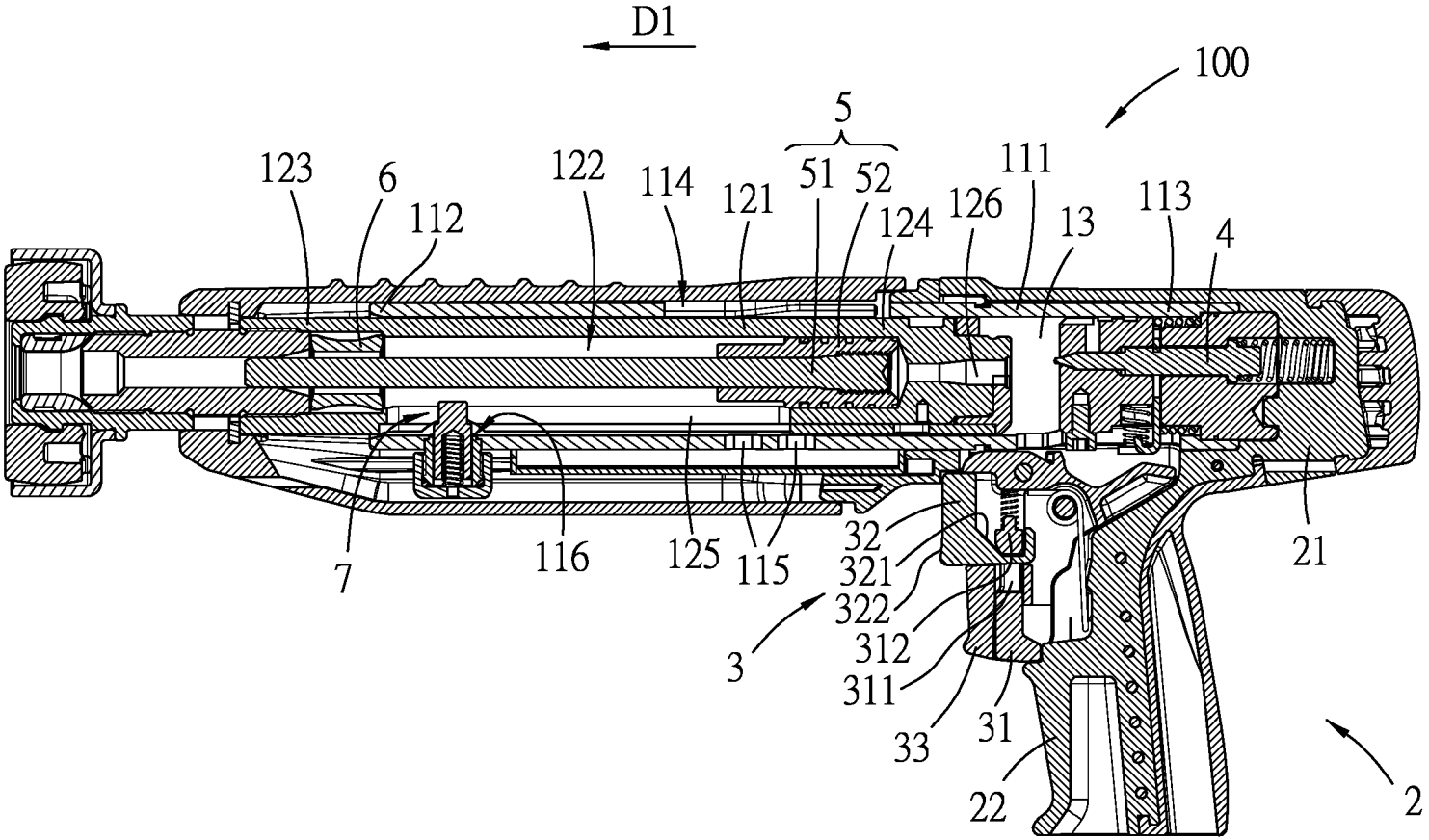
FIG. 5 is a sectional view of this embodiment.
Figure 6:
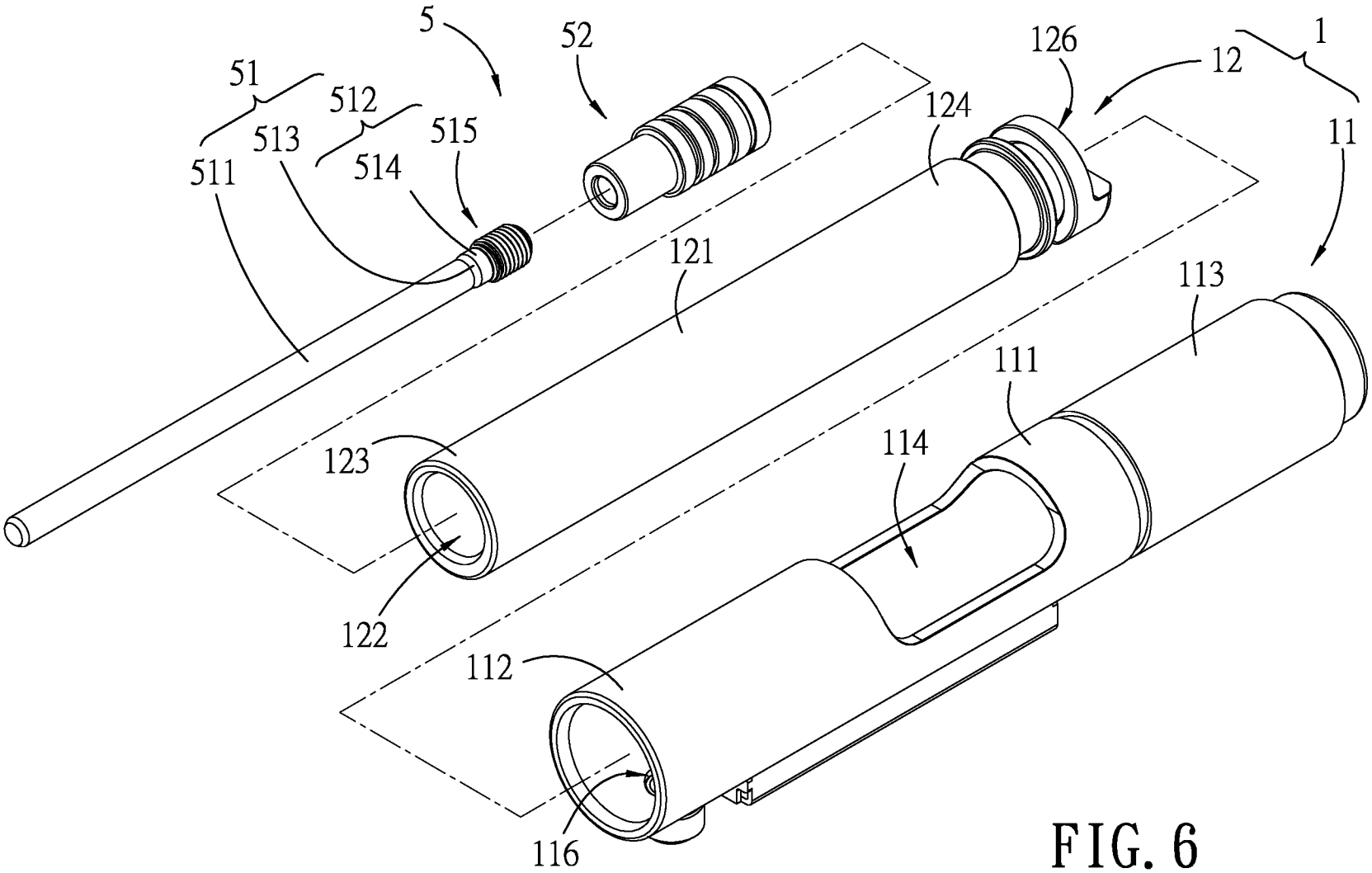
FIG. 6 is an exploded perspective view of a barrel assembly of the embodiment.

Referring to FIGS. 4 to 6, the embodiment of the powder-actuated tool 100 according to this disclosure is shaped like a handgun, and is adapted to use gunpowder as a power source to drive a nail (not shown). The powder-actuated tool 100 includes a barrel assembly 1, a housing 2, a trigger assembly 3, a firing pin device 4, a piston assembly 5, a buffer member 6, and a restoring device 7.

The barrel assembly 1 includes an outer tube 11, and an inner tube 12 that is telescopically connected to the outer tube 11.

The outer tube 11 has a lengthwise direction that defines a front-rear direction in this embodiment, and includes a main body portion 111, a front end portion 112 connected to a front end of the main body portion 111, and a rear end portion 113 connected to a rear end of the main portion 111. The main body portion 111 is formed with a slot 114 in a top surface thereof, two venting holes 115 in a bottom surface thereof, and a through hole 116 in the bottom surface thereof and proximate to the front end portion 112.

The inner tube 12 is movable forwardly and backwardly within the outer tube 11, and includes a main body portion 121, a front end portion 123 connected to a frond end of the main body portion 121, a rear end portion 124 connected to a rear end of the main portion 121, and a slot 125 formed in a bottom of the main body portion 121 along the front-rear direction. The main body portion 121, the front end portion 123 and the rear end portion 124 of the inner tube 12 cooperatively define an internal space 122 of the inner tube 12, where the internal space 122 has a powder chamber 126 formed at the rear end portion 124 of the inner tube 12 for receiving gunpowder.

The housing 2 includes a rear seat 21 that is fixedly connected to the rear end portion 113 of the outer tube 11, and a grip portion 22 that is connected to and disposed under the rear seat 21, and that is adapted to be gripped by a user.

The trigger assembly 3 is mounted to the grip portion 22, and includes a safety latch 31, a release button 32, and a trigger piece 33. When the safety latch 31 is at a locked position, the safety latch 31 abuts against the grip portion 22, thereby stopping the trigger piece 33 from being pressed, and preventing misoperation of the trigger piece 33 by the user. The safety latch 31 is formed with a notch 311, and has an upper end portion 312 that defines a top side of the notch 311. The release button 32 is protrusive in relation to the trigger piece 33 with respect to the grip portion 22, has a hook-shaped portion extending through the notch 311, and has a pressing surface 322 facing forwardly for being pressed by the user. The hook-shaped portion of the release button 32 has an inclined cam surface 321 that is inclined, and the upper end portion 312 of the safety latch 31 has an inclined cam follower surface that is in sliding contact with the cam surface 321, so that the release button 32 can drive movement of the safety latch 31 relative to the trigger piece 33. When the user presses the release button 32, the release button 32 will move the safety latch 31 upwardly because of the sliding contact between the cam surface 321 of the release button 32 and the cam follower surface of the upper end portion 312 of the safety latch 31, releasing the abutment between the safety latch 31 and the grip portion 22 when the pressing surface 322 of the release button 32 is flush with a front face of the trigger piece 33, so that the user can press the trigger piece 33 to drive the nail.

The firing pin device 4 is disposed in the rear seat 21, extends into the rear end portion 113 of the outer tube 11, and cooperates with the rear end portion 124 of the inner tube 12 to define a room 13 that is in spatial communication with the internal space 122 of the inner tube 12 via the powder chamber 126 of the inner tube 12. When the user presses the trigger piece 33 of the trigger assembly 3, the trigger assembly 3 will drive the firing pin device 4 to detonate the gunpowder so as to push and move the piston assembly 5 along a moving direction (D1) away from the rear end portion 124 of the inner tube 12 to shoot the nail outwardly and for example, into a target object. In detail, the explosion of the gunpowder causes gas in the powder chamber 126 to expand and enter the internal space 122 of the inner tube 12. The gas entering the internal space 122 of the inner tube 12 pushes the piston assembly 5 to move forwardly, so as to strike the nail out of the powder-actuated tool 100.

Figure 7:
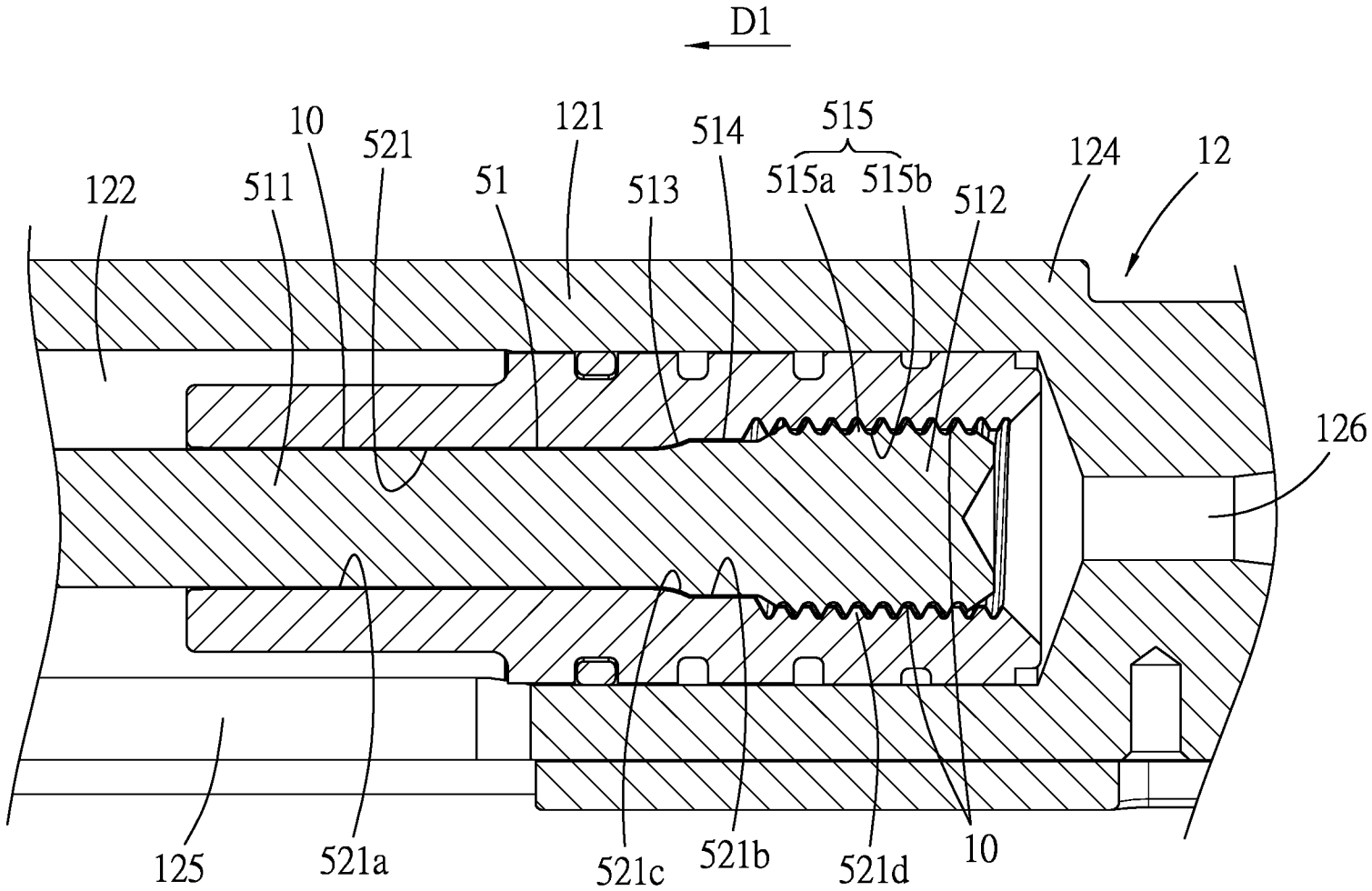
FIG. 7 is an enlarged fragmentary view of FIG. 5, illustrating a shoulder section of a pushing rod of a piston assembly of the embodiment.

Referring to FIGS. 5 to 7, the piston assembly 5 is disposed in the inner tube 12 of the barrel assembly 1, and includes a pushing rod 51 and a sleeve member 52. The pushing rod 51 has a main body 511 adapted for striking the nail, a tail section 512 connected to and disposed behind the main body 511 (i.e., relatively closer to the firing pin device 4 than the main body 511), and a shoulder section 513 connected between the main body 511 and the tail section 512. The tail section 512 has an outer diameter greater than that of the main body 511, and the shoulder section 513 has an outer diameter gradually reducing from the tail section 512 toward the main body 511. In more detail, the tail section 512 has an extension portion 514 connected to the shoulder section 513 and having an outer peripheral surface parallel to that of the main body 511, and an external threaded portion 515 extending from the extension portion 514 toward the rear end portion 124 of the inner tube 12. As a result, the external threaded portion 515 of the tail section 512 is spaced apart from the shoulder section 513 because of the extension portion 514. The external threaded portion 515 has a plurality of rounded crests 515*a*, and a plurality of rounded roots 515*b* each having a radius of curvature greater than 0.25 mm. In this embodiment, each rounded root 515*b* has a radius of curvature of 0.4 mm, but this disclosure is not limited in this respect. The sleeve member 52 is sleeved on the tail section 512, the shoulder portion 513, and a portion of the main body 511 of the pushing rod 51 in a form-fitting manner, and has an inner surface 521 in contact with the pushing rod 51. The sleeve member 52 has a first internal surface portion 521*a* corresponding in position to the main body 511 of the pushing rod 51, a second internal surface portion 521*b* corresponding in position to the extension portion 514 of the tail section 512 of the pushing rod 51, an internal shoulder surface portion 521*c* which interconnects the first and second internal surface portions 521*a*, 521*b*, and an internal threaded surface portion 521*d* connected to the second internal surface portion 521*b*. The second internal surface portion 521*b* defines an aperture having a diameter greater than that of an aperture defined by the first internal surface portion 521*a*. The internal shoulder surface portion 521*c* slantingly extends from the first internal surface portion 521*a* toward the second internal surface portion 521*b*, and corresponds in shape and in position to the shoulder section 513 of the pushing rod 51. The internal threaded surface portion 521*d* corresponds in shape and in position to the external threaded portion 515 of the pushing rod 51, and threadedly engages the external threaded portion 515 of the pushing rod 51, so as to prevent the pushing rod 51 and the sleeve member 52 from separation during use.

When the piston assembly 5 is driven by the explosion of the gunpowder to move forwardly along the moving direction (D1) to fix the nail onto a base object, the two-piece structure (pushing rod 51 and the sleeve member 52) eliminates the stress concentration of the piston assembly 5 at the joint or joints having large outer diameter differences, so as to prolong the life of the piston assembly 5. In addition, the curvature design for the rounded roots 515*b* may also alleviate the stress concentration.

The buffer member 6 is disposed at the front end portion 123 of the inner tube 12. In a case that the powder-actuated tool 100 is under abnormal use to result in the "piston overdrive", the sleeve member 52 directly hits the buffer member 6 in use, and the internal shoulder surface portion 521*c* of the sleeve member 52 may abut against the shoulder section 513 of the pushing rod 51 to prevent the sleeve member 52 from being separated from the pushing rod 51, and the life of the piston assembly 5 may thus be prolonged in the "piston overdrive" conditions. In this embodiment, the pushing rod 51 and the sleeve member 52 are both made of alloy steel, but the alloy steel used for the pushing rod 51 and the alloy steel used for the sleeve member 52 may have different compositions to result in different hardness, thereby achieving different requirements in usage, and thus being advantageous in comparison to a piston made in one piece or of a single material. For example, the pushing rod 51 may require a higher hardness (e.g., around 55 HRC in the Rockwell scale) because the pushing rod 51 is used to strike the nail, and the sleeve member 52 may have a lower hardness than that of the pushing rod 51 (e.g., around 50 HRC in the Rockwell scale) in order to enhance the tenacity of the sleeve member 52. Furthermore, a bonding material 10 that is less hard than the pushing rod 50 and the sleeve member 52 may be used to fill a space between the pushing rod 51 and the sleeve member 52 to enhance connection therebetween (i.e., a space between the sleeve member 52 and a portion of the pushing rod 51 that is sleeved by/inserted into the sleeve member 52 is almost or completely filled with the bonding material 10). In one implementation, the bonding material 10 may be a brazing material such that the pushing rod 51 and the sleeve member 52 are brazed together. In one implementation, the bonding material 10 is an adhesive material such that the pushing rod 51 is adhered to the sleeve member 52. The characteristic of being lower in hardness of the brazed material for brazing or the adhesive material in comparison to the pushing rod 51 and the sleeve member 52 may allow the brazing/adhesive material to absorb shock between the pushing rod 51 and the sleeve member 52, further prolonging the life of the piston assembly 5. For the current technology, the brazing material is a preferred implementation as both the bonding strength and the working temperature are higher than the adhesive material to meet the especially high impact and high temperature requirement of powder actuated tools in comparison to nail guns using other kinds of powering mechanisms.

Figure 8:
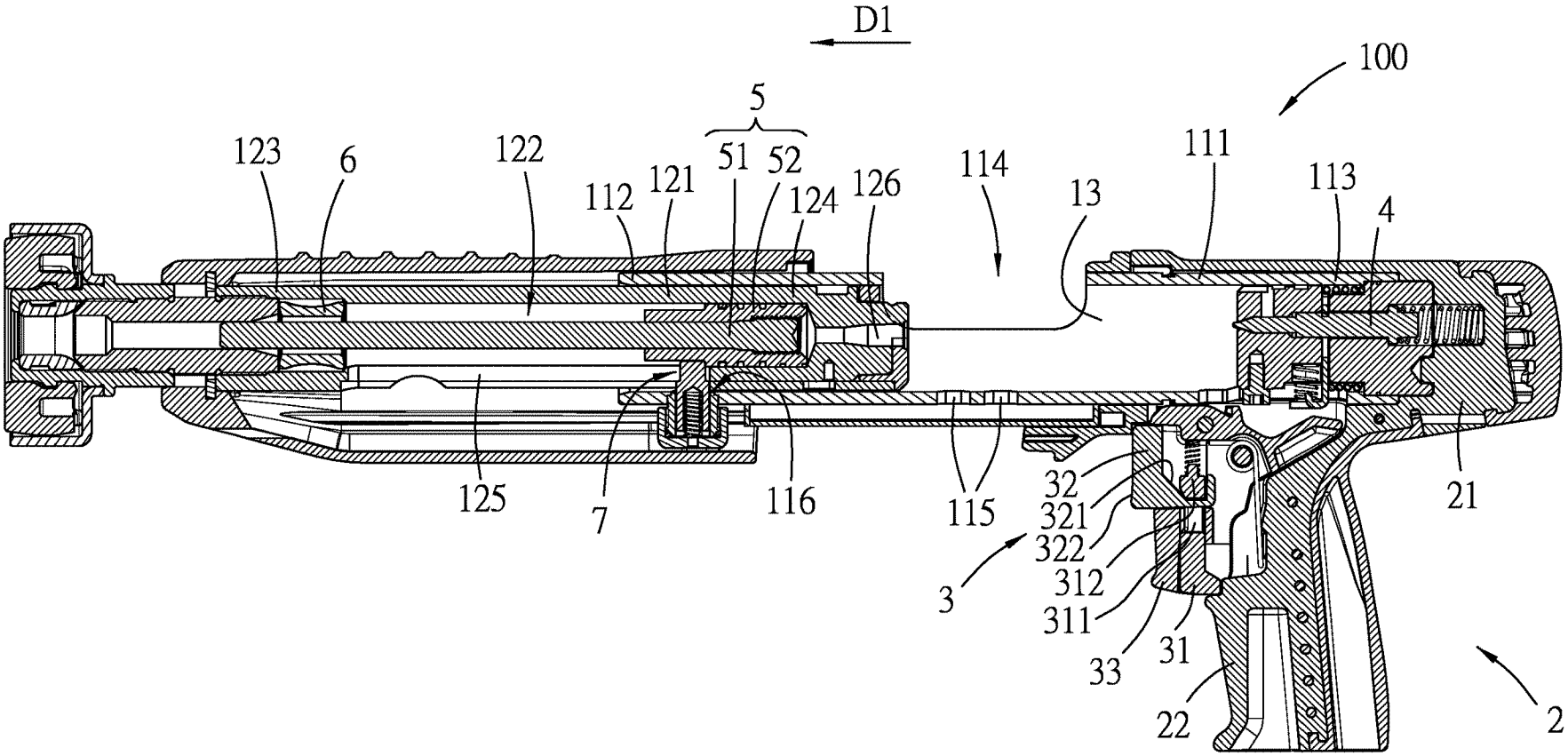
FIG. 8 is a sectional view of this embodiment in a condition that an inner tube of the barrel assembly is pulled away from a rear seat for restoring the piston assembly.

Referring to FIGS. 5, 6 and 8, the restoring device 7 vertically extends through the through hole 116 of the outer tube 11 and extends into the slot 125 of the inner tube 12. After each shot of the nail, the user may restore the piston assembly 5 for the next shot. In order to restore the piston assembly 5, the user may pull the inner tube 12 away from the rear seat 21 so that the restoring device 7 pushes the piston assembly 5 back to abutting against the rear end portion 124 of the inner tube 12 during the pulling of the inner tube 12. At this time, the slot 114 of the outer tube 11 would be exposed and become in spatial communication with the room 13, so that the user may supplement the gunpowder. Then, the user pushes the inner tube 12 back toward the rear seat 21, so as to complete the restoring of the piston assembly 5.

In summary, the embodiment of the powder-actuated tool 100 according to this disclosure has a piston assembly 5. In a case that the powder-actuated tool 100 is under normal use, the piston assembly 5 that is made with a two-piece structure alleviates stress concentration at the joints having different outer diameters, and threaded engagement between the pushing rod 51 and the sleeve member 52 prevents separation of the pushing rod 51 and the sleeve member 52 from each other. In a case that the powder-actuated tool 100 is under abnormal use to result in the "piston overdrive", the internal shoulder surface portion 521*c* of the sleeve member 52 may abut against the shoulder section 513 of the pushing rod 51 to prevent the sleeve member 52 from being separated from the pushing rod 51. The bonding material 10 that is applied between the pushing rod 51 and the sleeve member 52 further prolongs the life of the piston assembly 5 by shock absorption.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A powder-actuated tool adapted for driving a nail into an object, said powder-actuated tool comprising:

a barrel assembly including an outer tube, and an inner tube that is telescopically connected to said outer tube, said inner tube having a rear end portion formed with a powder chamber for receiving gunpowder;

a housing fixedly connected to a rear end of said outer tube;

a firing pin device disposed in said housing;

a piston assembly disposed in said inner tube of said barrel assembly, and including:

a pushing rod that has a main body, a tail section disposed behind said main body and having an outer diameter greater than that of said main body, and a shoulder section connected between said main body and said tail section and having an outer diameter gradually reducing from said tail section toward said main body; and a sleeve member that is sleeved on a portion of said main body and said tail section of said pushing rod in a form-fitting manner, and that has an inner surface in contact with said pushing rod and having an internal shoulder surface portion which corresponds in shape to said shoulder section of said pushing rod; and a bonding material that is less hard than said pushing rod and said sleeve member and that is connected between said pushing rod and said sleeve member, wherein said firing pin device is operable to detonate the gunpowder so as to push and move said piston assembly along a moving direction away from said rear end portion of the inner tube to shoot the nail into the object;

wherein said inner surface of said sleeve member further has an internal threaded surface portion that defines an aperture having a diameter greater than the outer diameter of said main body of said pushing rod, said tail section of said pushing rod having an external threaded portion that threadedly engages said internal threaded surface portion.

2. The powder-actuated tool as claimed in claim 1, wherein said external threaded portion of said tail section of said pushing rod has a plurality of rounded roots each having a radius of curvature greater than 0.25 mm.

3. The powder-actuated tool as claimed in claim 1, wherein said external threaded portion of said tail section is spaced apart from said shoulder section.

4. The powder-actuated tool as claimed in claim 1, wherein said sleeve member has a hardness that is lower than that of said pushing rod.

5. The powder-actuated tool as claimed in claim 1, wherein said bonding material is a brazing material such that said pushing rod and said sleeve member are brazed together.

6. The powder-actuated tool as claimed in claim 1, wherein said bonding material is an adhesive material such that said pushing rod is adhered to said sleeve member.

7. The powder-actuated tool as claimed in claim 1, wherein a space between said sleeve member and a portion of said pushing rod that is sleeved by said sleeve member is filled with said bonding material.

* * * * *